US008523315B2

(12) United States Patent
Shimoda

(10) Patent No.: US 8,523,315 B2
(45) Date of Patent: Sep. 3, 2013

(54) RECORDING DEVICE WITH A STORAGE SECTION INCLUDING AN ABSORPTION MEMBER TO STORE A WASTE LIQUID COLLECTED FROM A RECORDING HEAD ACCORDING TO THE OPERATION OF A PUMP WHICH RECEIVES INFORMATION FROM A PROCESSING UNIT WHICH RETAINS INFORMATION ABOUT WASTE LIQUID RETENTION AND PUMP OPERATION TIMES

(75) Inventor: Junji Shimoda, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 877 days.

(21) Appl. No.: 11/843,302

(22) Filed: Aug. 22, 2007

(65) Prior Publication Data

US 2008/0062222 A1 Mar. 13, 2008

(30) Foreign Application Priority Data

Sep. 8, 2006 (JP) ..... 2006-244148

(51) Int. Cl.
*B41J 2/165* (2006.01)

(52) U.S. Cl.
USPC ..... 347/23

(58) Field of Classification Search
None
See application file for complete search history.

(56) References Cited

U.S. PATENT DOCUMENTS 4,450,454 A * 5/1984 Koto ..... 347/108
4,965,596 A * 10/1990 Nagoshi et al. ..... 347/36
5,153,614 A 10/1992 Yamaguchi et al. ..... 346/140
5,764,253 A * 6/1998 Uchikata et al. ..... 347/23
6,729,184 B2 * 5/2004 Tsukada et al. ..... 73/290 V
7,029,090 B2 * 4/2006 Nishida et al. ..... 347/23
2005/0206674 A1 * 9/2005 Seki et al. ..... 347/30

FOREIGN PATENT DOCUMENTS

| | | |
|---|---|---|
| EP | 0427202 | 5/1991 |
| JP | 2003-127433 | 5/2003 |
| JP | 2005-066981 | 3/2005 |

OTHER PUBLICATIONS

Notice on the First Office Action, The State Intellectual Property Office of the People's Republic of China, dispatched Jun. 5, 2009, in counterpart application No. 200710149217.9. (with English translation).

* cited by examiner

*Primary Examiner* — Matthew Luu
*Assistant Examiner* — Alejandro Valencia
(74) *Attorney, Agent, or Firm* — Fitzpatrick, Cella, Harper & Scinto

(57) ABSTRACT

The liquid container has a first storage section in which ink to be supplied to an ink jet recording head is stored; a second storage section in which waste ink collected from the ink jet recording head is stored, and an information holding portion capable of recording information. The second storage section includes a waste ink absorption member which absorbs the waste ink. Moreover, in the information holding portion, information is recorded, the information including the total amount of the waste ink absorption by the ink absorption member, including an initial value of zero, the shortest time period X of continuous waste ink absorption, having a value which changes with the total amount of the waste ink absorption, and the previous collection time of the waste ink.

16 Claims, 6 Drawing Sheets

RECORDING DEVICE WITH A STORAGE SECTION INCLUDING AN ABSORPTION MEMBER TO STORE A WASTE LIQUID COLLECTED FROM A RECORDING HEAD ACCORDING TO THE OPERATION OF A PUMP WHICH RECEIVES INFORMATION FROM A PROCESSING UNIT WHICH RETAINS INFORMATION ABOUT WASTE LIQUID RETENTION AND PUMP OPERATION TIMES

BACKGROUND OF THE INVENTION

1. Field of the Invention

The present invention relates to a liquid container in which a liquid such as ink is stored, and an ink jet recording method of discharging ink droplets to record an image on a recording material, and more particularly, it relates to a liquid container to be detachably mounted on an ink jet recording device.

2. Description of the Related Art

Heretofore, a recording device which records an image on a recording material such as paper, cloth, a plastic sheet or a sheet for OHP has been proposed as a configuration on which various recording devices such as recording heads of a wire dot system, a thermal sensitive system, a thermal transfer system and an ink jet recording system can be mounted.

Among these systems, as a small-noise non-impact recording system, the ink jet recording system to discharge ink from a discharge port (a nozzle) arranged on a recording element and record the image on the recording material is incorporated in an ink jet recording device. The device can perform a high-density and high-speed recording operation.

The ink jet recording device employs a constitution corresponding to a function and a use configuration inherent in the system to which this recording device is applied. In general, the ink jet recording device includes a carriage on which an ink jet recording head is mounted, an ink tank as a liquid container which supplies ink to the recording head, a conveyance mechanism which conveys recording paper, and a control section which controls these components.

Moreover, the recording head which discharges ink droplets from a plurality of discharge ports is serially scanned in a direction (a main scanning direction) crossing a conveyance direction (a sub scanning direction) of recording paper. On the other hand, when the recording is not performed, the recording paper is intermittently conveyed (pitch conveyance) as much as an amount equal to a recording width. When the recording head including a large number of nozzles linearly arranged in parallel with the sub scanning direction to discharge ink is used and the recording head is scanned once on the recording paper, the recording is performed as much as a width corresponding to the number of the nozzles.

Moreover, since the ink jet recording device incurs a small running cost, the recording device can be miniaturized. Furthermore, the device can easily record a color image by use of a plurality of colors of ink.

For the above reasons, the ink jet recording device is used as an output unit of an information system, for example, a printer as an output terminal of a photocopier, a facsimile machine, an electronic typewriter, a word processor, a work station or the like. Alternatively, the ink jet recording device is used as a handy or portable printer disposed at a personal computer, an optical disk drive, a video device or the like.

On the other hand, as an energy generation element which allows the recording head to discharge the ink from the discharge ports, an electromechanical conversion member such as a piezo element is used. Alternatively, a liquid is heated by an electrothermal conversion element having a heating resistor member.

Above all, according to the recording head of the ink jet recording system in which the ink droplets are discharged using thermal energy, since the discharge ports are highly densely arranged, the image can be recorded with high resolution. Above all, when the electrothermal conversion element is used as the energy generation element in the recording head, the heat is easily miniaturized. Moreover, merits of the recording head can sufficiently be used in an IC technology and a micro processing technology which have remarkably advanced and have improved reliability thereof in a semiconductor field in recent years. The recording head using the electrothermal conversion element is advantageous because the head can highly densely be mounted easily, and manufactured with low cost.

The ink tank usually includes a storage bag in which the ink to be supplied to the recording head is stored, a joint portion to be connected to the ink jet recording device, and a housing in which these components are incorporated. In the ink jet recording device, preliminary discharge is performed in order to prevent an initial discharge defect after the recording head is left to stand for a short time period. Also in the device, an ink sucking operation from the recording head left to stand for a long time period is periodically performed in order to prevent non-discharge due to mixed bubbles after the recording head is left to stand for the long time period.

Waste ink generated by the preliminary discharge and the periodic ink suction from the recording head is discharged into the ink jet recording device. In order to miniaturize the whole ink jet recording device, the conventional ink tank includes a waste ink absorption member in which the waste ink generated by the preliminary discharge and the periodic ink suction is collected and stored. This waste ink absorption member is incorporated in the housing.

That is, the waste ink which has originally been discharged into the ink jet recording device is absorbed by the waste ink absorption member, and the member is arranged in the ink tank. According to such a constitution, the ink jet recording device can be miniaturized. Furthermore, the ink tank is replaced with a new ink tank at a time when the ink to be supplied to the recording head is consumed. That is, when the ink tank is replaced, the waste ink absorption member disposed in the ink tank is replaced with a new member. Therefore, even in a case where it is constituted that the waste ink absorption member is incorporated in the ink tank, the ink tank is inhibited from being excessively enlarged.

As the constitution in which the waste ink absorption member is incorporated in the ink tank to miniaturize the recording device, a constitution is disclosed in which the waste ink absorption member is incorporated in the ink tank and further the recording device includes a unit to distribute the waste ink to a plurality of ink tanks (see Japanese Patent Application Laid-Open No. 2003-127433). In this constitution, since the waste ink is distributed to the plurality of ink tanks by the recording device, the whole recording device can be miniaturized.

In this type of ink jet recording device, when the waste ink is collected in the ink tank, the waste ink needs to be securely absorbed by the waste ink absorption member disposed in the ink tank. In a case where the waste ink is not absorbed or stored in the waste ink absorption member to cause existence of floating ink, the ink might leak from the ink tank. To prevent such ink leakage, in the conventional ink tank, a joint portion for the waste ink via which the waste ink is introduced into the ink tank needs to be hermetically closed with a rubber seal or the like. This structure is one cause for increase of the manufacturing cost of the ink tank.

SUMMARY OF THE INVENTION

To solve the problem, an object of the present invention is to provide a liquid container and a recording device so that waste liquid can securely be collected by an absorption member disposed in the waste liquid to prevent drop of reliability due to liquid leakage with a comparatively simple and inexpensively manufactured constitution.

To achieve the above object, a constitution of the present invention is a recording device on which a storage section including an absorption member to store a waste liquid collected from the recording head, and an information holding portion which retains information, the recording device comprising:

a pump which feeds the waste liquid collected from the recording head to the second storage section; and a control unit which controls the pump, wherein the control unit controls an operation of the pump based on the information retained by the information holding portion, the information including information on the total amount of the waste liquid absorbed by the absorption member, and information on the previous operation time of the pump.

According to the present invention, when the waste liquid is discharged into the liquid container, liquid leakage from the liquid container can be prevented from being caused by existence of a floating liquid generated in a case where the waste liquid is not securely collected by a waste liquid absorption member disposed in the liquid container.

Moreover, according to the present invention, by a comparatively simple method with a small manufacturing cost, the waste liquid can securely be collected by the waste liquid absorption member disposed in the liquid container to prevent drop of reliability due to the liquid leakage.

Further features of the present invention will become apparent from the following description of exemplary embodiments with reference to the attached drawings.

DESCRIPTION OF THE EMBODIMENTS

Embodiments of a liquid container, a recording device and a liquid collection system according to the present invention will hereinafter be described with reference to the drawings.

An ink tank of the present embodiment is a so-called main ink tank. In the tank, ink as a liquid to be supplied to a sub ink tank is stored. The sub ink tank is to be moved integrally with a recording head which discharges a liquid in the recording device. The ink is supplied from the ink tank to the recording head via this sub ink tank.

Figure 1:
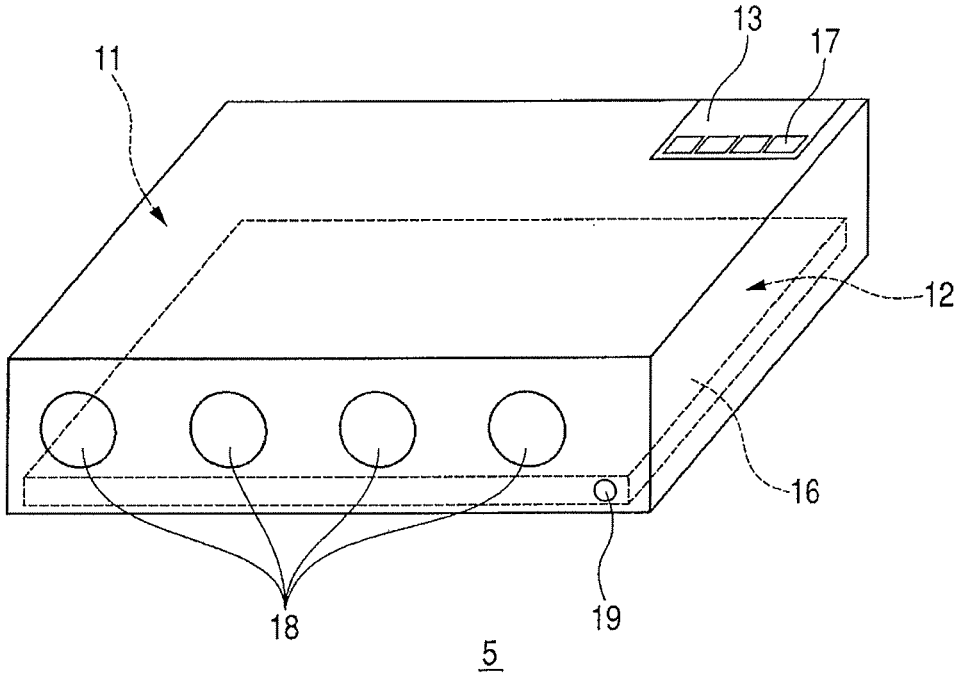
FIG. 1 is a perspective view showing an ink tank according to an embodiment.
Figure 2:
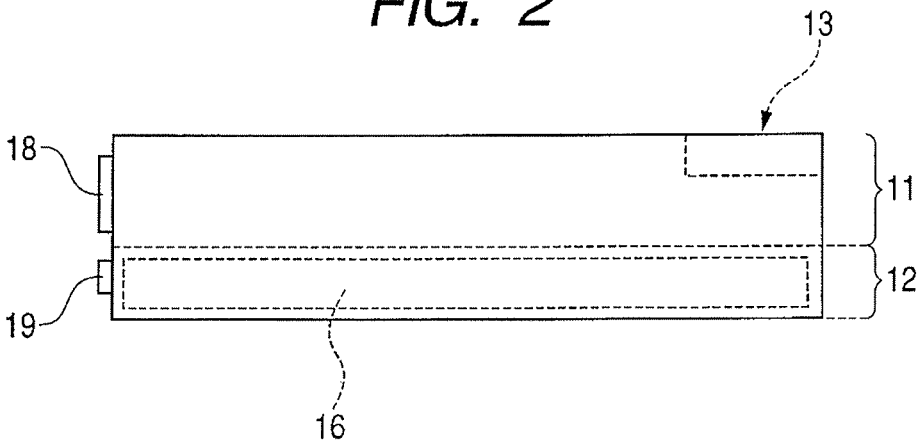
FIG. 2 is a side view showing the ink tank.

FIG. 1 is a perspective view showing the ink tank which is an embodiment of the liquid container. As shown in FIG. 1, an ink tank 5 of the embodiment includes a first storage section 11 in which the ink to be supplied to an ink jet recording head is stored, and a second storage section 12 in which waste ink as a waste liquid collected from the ink jet recording head is stored. The ink tank 5 also includes an information holding portion 13 which can retain information concerned with the waste ink to be collected from the ink jet recording head.

The first storage section 11 has a plurality of storage chambers in which a plurality of colors of ink to be supplied to the recording head are stored independently of one another. The first storage section 11 is provided with a plurality of joint portions 18 for ink supply which are connected to an ink supply system on the side of the ink jet recording device. From the joint portions, the plurality of colors of ink are supplied to the recording head. As one example, the ink tank 5 of the present embodiment includes the joint portions 18 for supplying the ink of four colors of yellow (Y), magenta (M), cyan (C) and black (K).

Moreover, in the ink jet recording head on which the ink tank 5 is mounted, after the ink jet recording head is left to stand for a short time, the ink is preliminarily discharged in order to prevent an initial discharge defect. In this ink jet recording device, when the ink jet recording head is left to stand for a long time, the ink is periodically sucked. This is performed in order to prevent that the ink jet recording head does not discharge any ink owing to bubbles mixed in the ink jet recording head which has been left to stand for the long time.

To perform this operation, the second storage section 12 includes a waste ink absorption member 16 in which the waste ink generated by the preliminary discharge and the periodic ink suction is collected from the recording head and stored. The waste ink does not contribute to image formation. The second storage section 12 also includes a joint portion 19 for ink collection into which the waste ink collected from the ink jet recording head is introduced.

Moreover, the information holding portion 13 of the ink tank 5 includes an information recording medium 17 in which information can be recorded. In this information recording medium 17, information on a total amount of waste ink absorption is recorded as a total amount of the waste ink absorbed by the waste ink absorption member 16. As this total waste ink absorption, an initial value of "0" is recorded, when the ink tank is a new tank. In the information recording medium 17, a waste ink collection time (a collection period) of one past time close to the present time, that is, the previous time is recorded. Any waste ink collection time is not recorded, when the ink tank 5 is the new tank.

Furthermore, in the information recording medium 17, information on the shortest time period from a time when the collection of the waste ink into the ink tank 5 is completed until the next waste ink collection can be performed is stored.

The next waste ink collection cannot be performed until the waste ink fed to the second storage section 12 by the previous waste ink collection is sufficiently absorbed by the waste ink absorption member 16. If the next waste ink collection is performed with the non-absorbed waste ink left in the waste ink absorption member 16, the waste ink cannot be absorbed by the waste ink absorption member 16, and leaks from the second storage section 12.

The shortest time period X of the waste ink absorption is a waiting time required until the amount of the waste ink which is not absorbed by the waste ink absorption member 16 from the previous waste ink collection decreases to a predetermined amount or less and newly collected waste ink can sufficiently be absorbed by the waste ink absorption member 16.

It is to be noted that the shortest time period X of the waste ink absorption is a value which changes with the total amount of the waste ink absorption. When the total amount of the waste ink absorption increases, the shortest time period X of the waste ink absorption gradually increases.

That is, information to be recorded in the information recording medium 17 includes the total amount of the waste ink absorption by the waste ink absorption member 16 including an initial value of zero, the shortest time period X of the waste ink absorption having a value which continuously changes with the total amount of the waste ink absorption, and the previous collection time of the waste ink.

TABLE 1

| Total amount (CC) of waste ink | Shortest time period X of waste ink absorption (second) | |
|---|---|---|
| absorption | First ink 3A | Second ink 3B |
| 0 to 1 | 50 | 120 |
| 2 to 3 | 50 | 120 |
| 3 to 4 | 50 | 125 |
| 4 to 5 | 55 | 130 |
| 5 to 6 | 60 | 150 |

Table 1 shows one example of the shortest time period X of the waste ink absorption. The shortest time period X of the waste ink absorption differs with a type of the ink. When the ink is permeable ink (hereinafter referred to as the first ink) such as color ink including a surface active agent, a value of the period is comparatively small. When the ink is impermeable ink (hereinafter referred to as the second ink) such as black pigment ink, the value of the period comparatively increases. Table 1 shows first ink 3A and second ink 3B as typified ink.

Moreover, in actual, the waiting time from the previous waste ink absorption until the next waste ink absorption can be performed also changes with the amount of the previously collected waste ink. The amount of the waste ink to be collected differs between the preliminary discharge and restorative suction. Each of the preliminary discharge and the restorative suction has a plurality of modes, and the amount of the waste ink to be collected differs with the mode. Therefore, as shown in Table 1, the shortest time period X of the absorption extracted from the table for use in a case where a standard amount of the waste ink is collected is sometimes corrected in accordance with an actual amount of the waste ink absorption.

Furthermore, as the total amount of the waste ink absorption by the waste ink absorption member 16 increases, an ink absorption capability of the waste ink absorption member 16 gradually deteriorates. Therefore, the amount of the waste ink absorption per unit time gradually decreases. Table 1 shows one example in which the shortest time period X of the waste ink absorption changes with the total amount of the waste ink absorption, in a case where it is assumed that the waste ink can sufficiently be absorbed by the waste ink absorption member 16 within this period and any floating ink does not exist. It is to be noted that this value of the shortest time period X of the waste ink absorption is determined by the type of the ink as described above. In addition, the value is determined by a structure of the ink tank, and a material and a shape of the waste ink absorption member 16.

Figure 3:
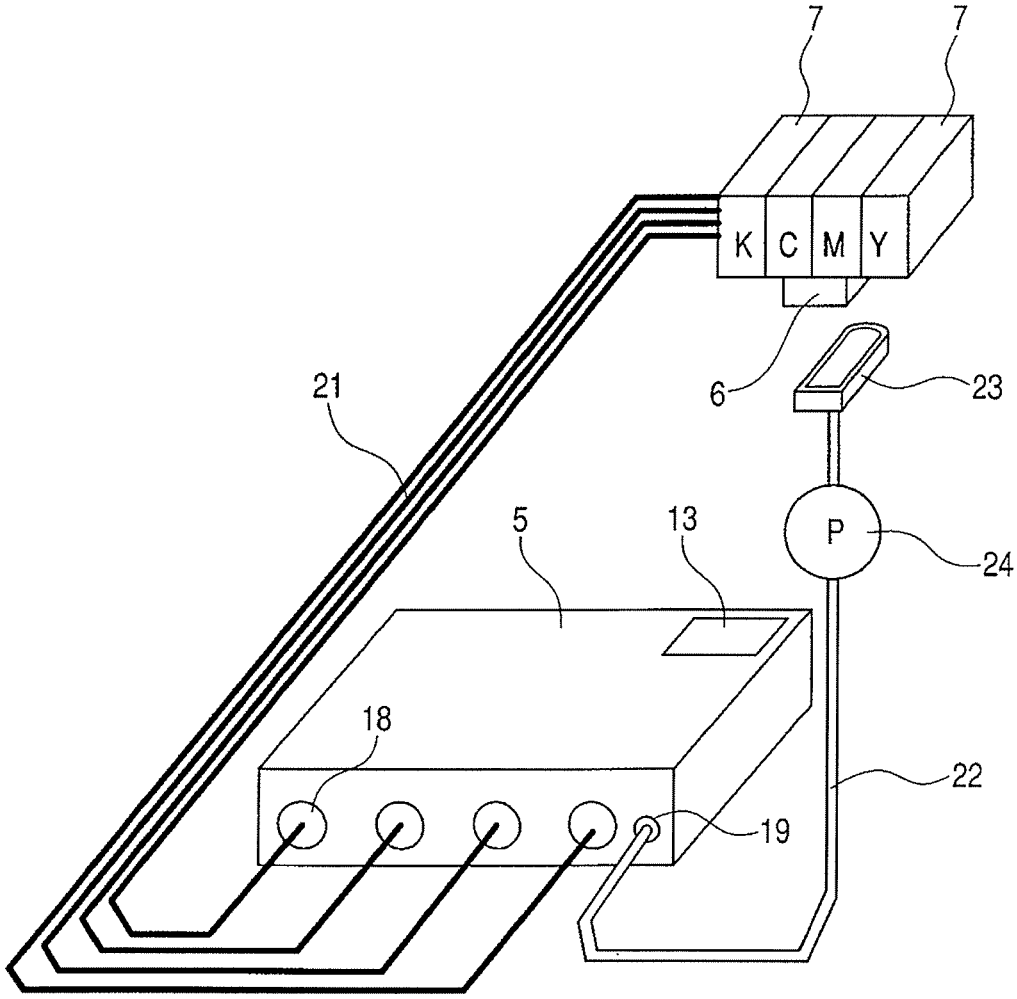
FIG. 3 is a perspective view showing an ink supply system on the side of an ink jet recording device to which the ink tank of the present embodiment is applied.

FIG. 3 is a perspective view showing an ink supply system on the side of the ink jet recording device. As shown in FIG. 3, the ink supply system in which the above ink tank (the main tank) 5 of the embodiment is used includes an ink jet recording head 6 which discharges ink droplets to form an image, characters and the like on a recording material. This ink supply system includes a sub ink tank 7, and a tank attaching portion (not shown) to which the ink tank 5 is detachably attached. The sub ink tank has a function of supplying the ink supplied from the ink tank 5 to the ink jet recording head 6 to maintain an appropriate negative pressure.

As one example, the inside of the sub ink tank 7 is divided into ink chambers of four colors of yellow (Y), magenta (M), cyan (C) and black (K). The ink jet recording head 6 is constituted integrally with the sub ink tank 7. When the recording material is scanned and the ink jet recording head 6 discharges a plurality of colors of ink droplets, an image is formed on the recording material.

The ink tank 5 of the present embodiment is connected to the sub ink tank 7 via ink supply tubes 21, and the ink is supplied from the ink tank 5 to the sub ink tank 7 via the ink supply tubes 21. Instead of the ink supply tubes 21, a joint mechanism (not shown) via which the sub ink tank 7 is disconnectably connected to the ink tank 5 may be provided, and the present invention is applicable to such a constitution.

The ink jet recording head 6 causes an initial discharge defect even after the head is left to stand for a comparatively short period. Therefore, when the head is left to stand even for a short period, the preliminary discharge is performed in order to prevent the initial discharge defect before the image is recorded in the recording material. Moreover, bubbles are sometimes mixed in the ink jet recording head 6 after the head is left to stand for a long period. In this case, an operation of sucking the bubbles from the ink jet recording head 6 is performed. Furthermore, the ink is sucked. This ink sucking operation is usually performed periodically after the ink jet recording head 6 is left to stand for the long period.

As shown in FIG. 3, a suction cap 23 which abuts on the ink jet recording head 6 on a discharge port side is connected to a suction pump 24 and the ink tank 5 via a waste ink discharge tube 22. To perform the above preliminary discharge in order to prevent the initial discharge defect, after the ink jet recording head 6 is moved to and fixed at such a position as to face the suction cap 23, the ink jet recording head 6 discharges the plurality of ink droplets into the suction cap 23. Subsequently, when the suction pump 24 is operated, the waste ink discharged into the suction cap 23 by the preliminary discharge is circulated through the ink tank 5 via the waste ink discharge tube 22, sucked by the waste ink absorption member 16 and stored in the ink tank 5. The amount of the waste ink to be discharged into the suction cap 23 by the preliminary discharge sometimes differs with the mode of the preliminary discharge. The amount of the waste ink to be discharged into the suction cap 23 by the preliminary discharge is smaller than the amount of the waste ink to be generated by the restorative suction described later. Therefore, the suction pump 24 is operated, when the preliminary discharge is performed several times.

Moreover, in the ink sucking operation of removing the bubbles after the ink jet recording head 6 is left to stand for the long period as described above, the ink jet recording head 6 is moved to and fixed at such a position as to face the suction cap 23. Subsequently, after the suction cap 23 is brought into close contact with the ink jet recording head 6 on the discharge port side, the suction pump 24 is operated, thereby performing the ink sucking operation. The waste ink generated by this restorative suction operation is circulated through the ink tank 5 via the waste ink discharge tube 22, absorbed by the waste ink absorption member 16 and stored in the ink tank 5. The amount of the waste ink to be generated by the restorative suction operation sometimes differs with the mode of the restorative suction.

Figure 4:
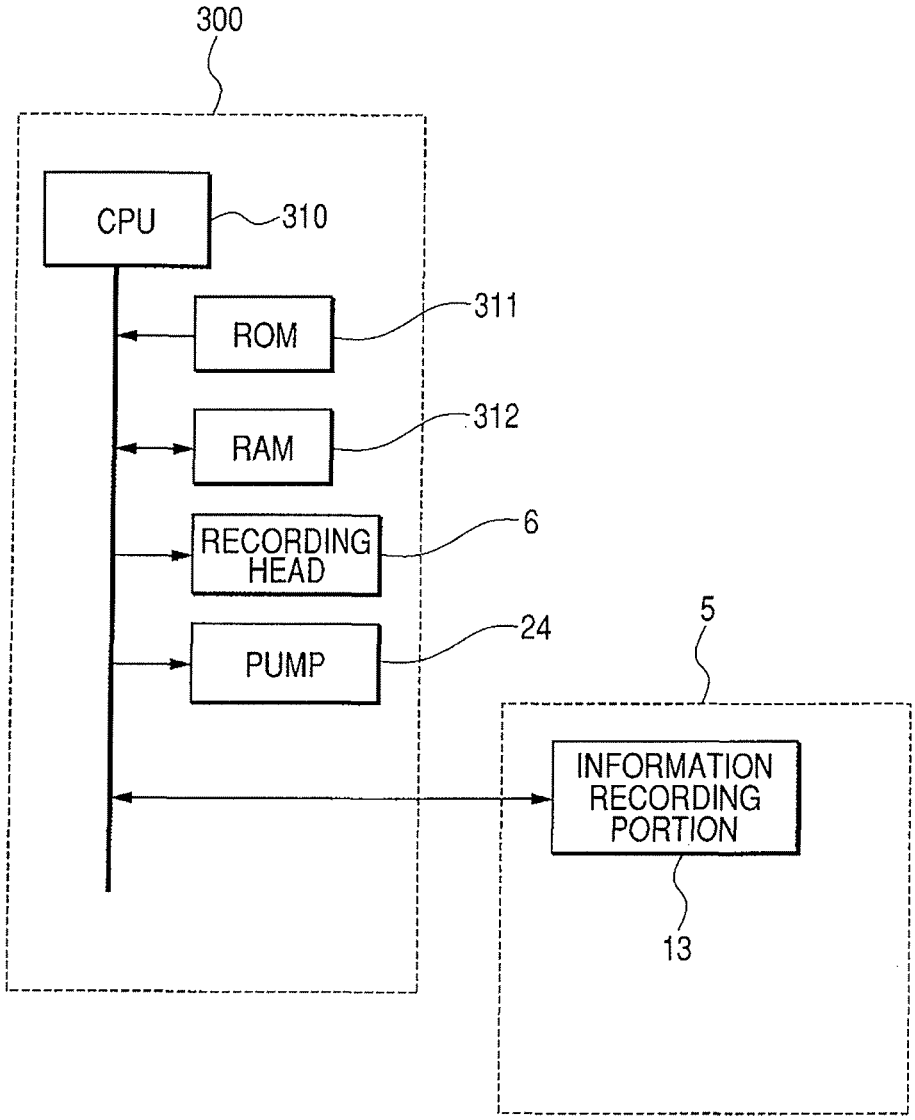
FIG. 4 is a circuit diagram of the ink jet recording device and the ink tank.

FIG. 4 is a circuit diagram of the ink jet recording device.

An ink jet recording device main body 300 includes a CPU 310, an ROM 311 in which a control program and data are stored and an RAM 312 in which data of control, image processing and the like is temporarily stored and from which the data is read.

When the ink tank 5 is mounted on the recording device 300, the information holding portion 13 is connected to the CPU 310 via an electric contact, so that the information can be recorded in the information recording medium 17 of the information holding portion 13 and can be read from the information recording medium 17.

Alternatively, the information holding portion 13 and the CPU 310 may exchange the information by radio.

Figure 5:
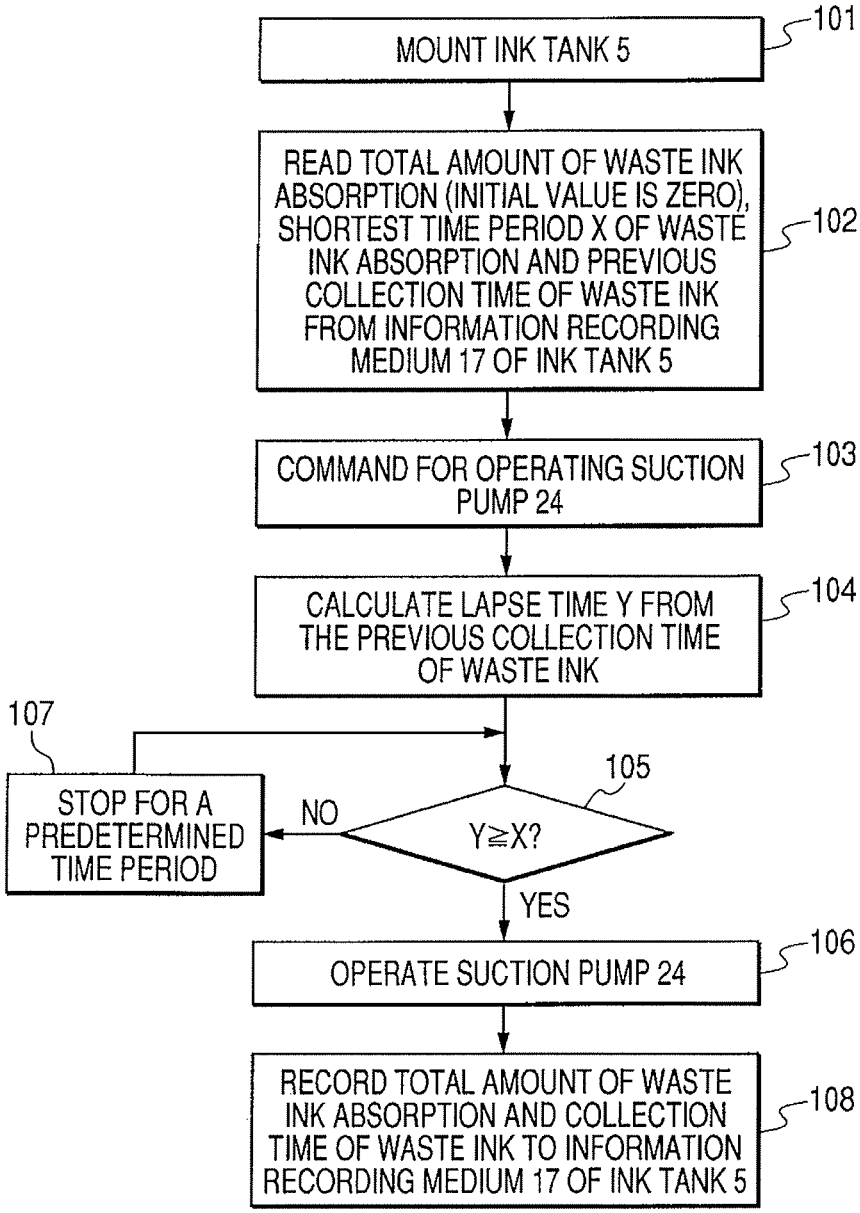
FIG. 5 is a flow chart showing an operation of discharging waste ink.

FIG. 5 is a flow chart showing an operation of discharging the waste ink according to the present embodiment. As shown in step 101 of FIG. 5, the ink tank 5 is mounted on a tank mounting portion of the ink jet recording device. When the ink tank 5 is mounted, as shown in step 102, the total amount of the waste ink absorption is read by a control section (not shown) of the ink jet recording device from the information recorded in the information recording medium 17 of the information holding portion 13 disposed at the ink tank 5. It is to be noted that this total amount of the waste ink absorption has an initial value of "zero", when the ink tank 5 is a new tank. This value is read by the control section of the ink jet recording device.

Moreover, when the waste ink is continuously discharged to the waste ink absorption member 16, the shortest time period X of the waste ink absorption corresponding to the total amount of the waste ink absorption is read from the information recording medium 17 of the ink tank 5 by the control section of the ink jet recording device. This shortest time period X of the waste ink absorption is the shortest time period when the waste ink can sufficiently be absorbed by the waste ink absorption member 16 and any floating ink does not exist in the second storage section 12 of the ink tank 5. The previous collection time of the waste ink is read from the information recording medium 17 by the control section of the ink jet recording device. However, the time is not read, when the ink tank 5 is the new tank.

Subsequently, when the suction pump 24 needs to be operated, as shown in step 103, a command for operating the suction pump 24 is generated in the ink jet recording device. When the command for operating the suction pump 24 is generated, first as shown in step 104, a lapse time Y from the previous collection time of the waste ink up to now is calculated. Subsequently, as shown in step 105, this lapse time Y from the previous collection time of the waste ink is compared with a value of the shortest time period X of the waste ink absorption.

When $Y \geqq X$, a sufficient time elapses from the previous time when the waste ink is discharged into the ink tank 5 and absorbed by the waste ink absorption member 16. Therefore, in a case where the waste ink is absorbed by the waste ink absorption member 16, any floating ink does not exist in the ink tank 5 and the waste ink is newly discharged into the tank, it is judged that the waste ink can be absorbed by the waste ink absorption member 16. The step advances to step 106 to operate the suction pump 24. In consequence, the waste ink is discharged into the second storage section 12 of the ink tank 5, and absorbed by the waste ink absorption member 16.

When $Y<X$, as shown in step 107, the suction pump is stopped for a predetermined time period, and waits until $Y \geqq X$ is satisfied. Subsequently, when $Y \geqq X$ is satisfied, the suction pump 24 operates. During this stop, a sufficient time elapses from the previous time when the waste ink is discharged into the ink tank 5 and absorbed by the waste ink absorption member 16. Therefore, the existence of the floating ink in the second storage section 12 of the ink tank 5 is eliminated. Therefore, even when the waste ink is newly discharged to the second storage section 12, the waste ink can satisfactorily be absorbed by the waste ink absorption member 16. The ink leakage due to overflow of the waste ink can be prevented. Finally, after the operation of the suction pump 24 ends, as shown in step 108, the total amount of the waste ink absorption and the collection time of the waste ink are recorded in the information recording medium 17 of the ink tank 5, respectively. In consequence, a series of operations of discharging the waste ink are completed.

The total amount of the waste ink absorption is obtained by adding the amount of the ink presently fed by the suction pump 24 to the total amount of the waste ink absorption read from the information recording medium 17 in the step 102 before operating the suction pump 24. The amount of the waste ink to be generated by the restorative suction and the preliminary discharge differs with the mode. In the ROM 311 or the RAM 312, information on the amount of the waste ink to be generated by each mode of restorative suction and each mode of preliminary discharge is stored. The amount of the ink fed into the second storage section 12 by the suction pump 24 is calculated based on the information. The calculation result is added to the total amount of the waste ink absorption read from the information recording medium 17. When the preliminary discharge is performed a plurality of times, the waste ink is collected from the cap 23 in some case. In this case, the amount of the waste ink preliminarily discharged the plurality of times is added. This value is newly stored in the information recording medium 17.

A value obtained by further subtracting the amount of the ink evaporated from the second storage section 12 may be stored according to the lapse time from the previous collection time of the waste ink.

As the collection time of the waste ink, a pump operating time such as a time when the operation of the suction pump 24 is started or stopped is used.

As described above, according to the ink tank 5 of the embodiment including the information holding portion 13, it can be prevented that the waste ink is discharged into the second storage section 12 in a case where the floating ink which is not absorbed by the waste ink absorption member 16 of the second storage section 12 exists. Therefore, according to this ink tank 5, when the waste ink is discharged into the second storage section 12, the ink leakage from the ink tank 5 can be prevented.

Furthermore, according to this ink tank 5, the joint portion 19 for ink collection does not have to employ a special sealed structure. Therefore, with a comparatively simple constitution and low manufacturing cost, the first ink is securely collected by the waste ink absorption member 16, and drop of reliability due to the ink leakage can be prevented.

(Another Embodiment)

An ink tank according to another embodiment will be described with reference to the drawings. The tank includes a light emitting portion which emits light to indicate that the waste ink collecting operation is stopped for the predetermined time period. Since the present embodiment has substantially the same constitution as that of the ink tank 5 of the above embodiment, the same members are denoted with the same reference numerals for description.

Figure 6:
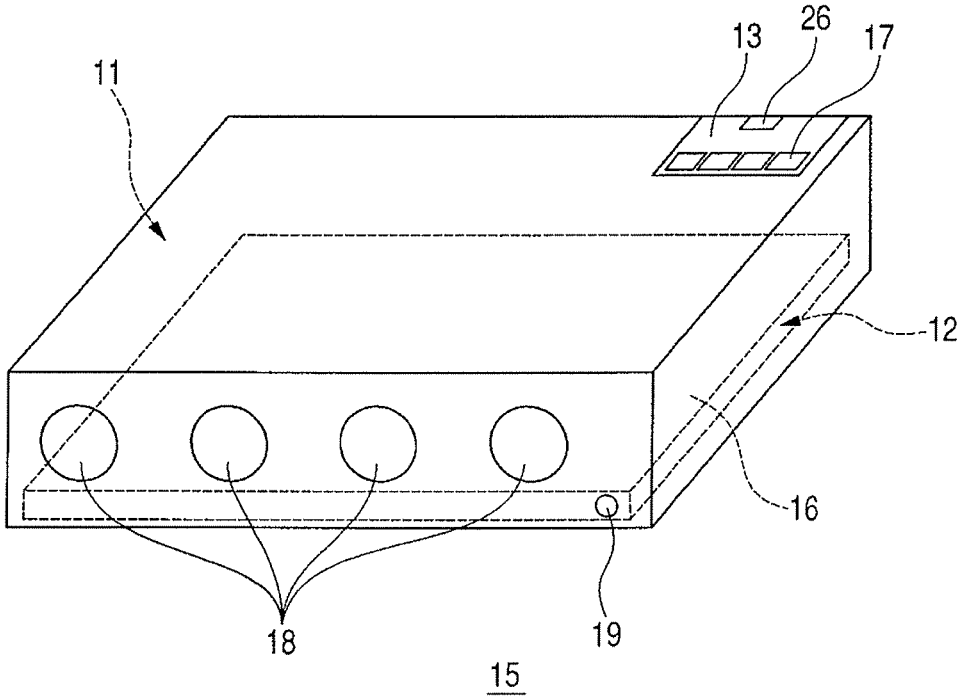
FIG. 6 is a perspective view showing an ink tank according to another embodiment.

FIG. 6 is a perspective view showing the ink tank according to the other embodiment. As shown in FIG. 6, a first storage section 11 of an ink tank 15 of the present embodiment includes joint portions 18 of four colors of yellow (Y), magenta (M), cyan (C) and black (K) in the same manner as in the constitution shown in FIG. 1.

Moreover, the second storage section 12 of the ink tank 15 includes a waste ink absorption member 16 in which waste ink is collected and stored in the same manner as in the constitution shown in FIG. 1. The ink tank 15 includes a light emitting portion 26 to emit visible light which can visually be recognized by a user, and an information holding portion 13 having an information recording medium 17 in which the information can be recorded. The light emitting portion 26 of the present embodiment contains a control circuit which controls a light emission state.

As shown in FIG. 6, in the same manner as in the above embodiment, a total amount of waste ink absorption is recorded in the information recording medium 17. When the ink tank 15 is a new tank, an initial value of "zero" is recorded as this total amount of the waste ink absorption. In the information recording medium 17, a collection time of the waste ink of one past time close to the present time, that is, the previous time is stored. When the ink tank 15 is the new tank, the collection time of the waste ink is not recorded. Furthermore, the shortest time period X of the waste ink absorption is also recorded. The period is the shortest time period when the waste ink can sufficiently be absorbed by the waste ink absorption member 16 and any floating ink does not exist, in a case where the waste ink is discharged to the waste ink absorption member 16. A value of the period changes with the total amount of the waste ink absorption.

Figure 7:
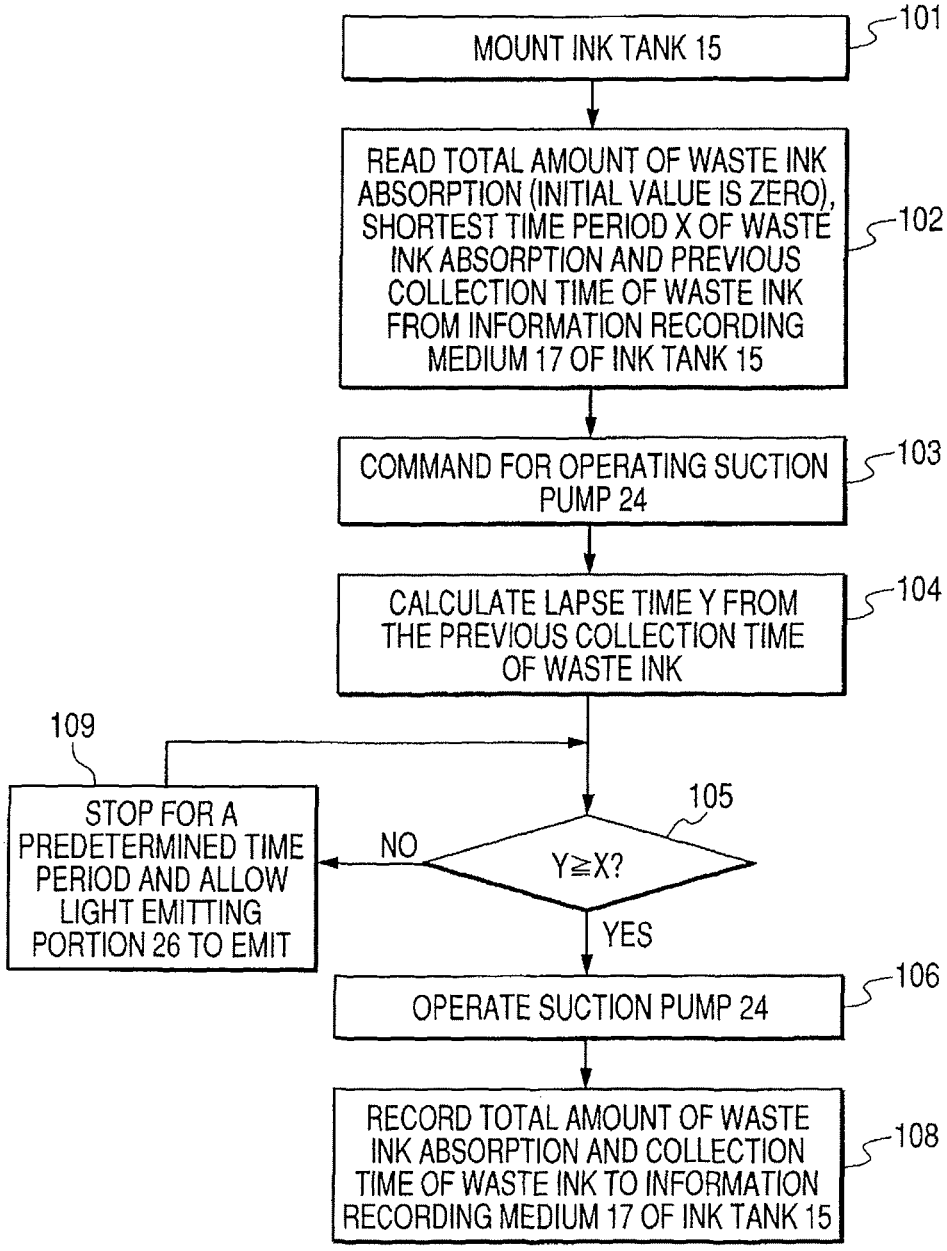
FIG. 7 is a flow chart showing an operation of discharging waste ink according to the other embodiment.

FIG. 7 is a flow chart showing an operation of discharging the waste ink according to the ink tank of the other embodiment. As shown in step 101 of FIG. 7, the ink tank 15 is mounted on a tank mounting portion of the ink jet recording device. When the ink tank 15 is mounted, as shown in step 102, the total amount of the waste ink absorption is read by a control section of the ink jet recording device from the information recording medium 17 of the information holding portion 13 disposed at the ink tank 15 in the same manner as described above. It is to be noted that this total amount of the waste ink absorption has an initial value of "zero", when the ink tank 15 is a new tank. This value is read by the control section of the ink jet recording device.

Moreover, when the waste ink is continuously discharged to the waste ink absorption member 16, the shortest time period X of the waste ink absorption corresponding to the total amount of the waste ink absorption is read from the information recording medium 17 of the ink tank 15 by the control section of the ink jet recording device. This shortest time period X of the waste ink absorption is the shortest time period when the waste ink can sufficiently be absorbed by the waste ink absorption member 16 and any floating ink does not exist in the second storage section 12 of the ink tank 15. The previous collection time of the waste ink is read from the information recording medium 17 by the control section of the ink jet recording device. However, the time is not read, when the ink tank 15 is the new tank.

Subsequently, when the suction pump 24 needs to be operated, as shown in step 103, a command for operating the suction pump 24 is generated in the ink jet recording device in the same manner as described above. When the command is generated, first as shown in step 104, a lapse time Y from the previous collection time of the waste ink up to now is calculated. Subsequently, as shown in step 105, this lapse time Y from the previous collection time of the waste ink is compared with a value of the shortest time period X of the waste ink absorption.

When $Y \geqq X$, a sufficient time elapses from the previous time when the waste ink is discharged into the ink tank 15 and absorbed by the waste ink absorption member 16. Therefore, in a case where the waste ink is absorbed by the waste ink absorption member 16, any floating ink does not exist in the ink tank 15 and the waste ink is newly discharged into the tank, it is judged that the waste ink can be absorbed by the waste ink absorption member 16. The step advances to step 106 to operate the suction pump 24. In consequence, the waste ink is discharged into the waste ink absorption member 16 of the second storage section 12 of the ink tank 5.

When $Y<X$, as shown in step 109, the suction pump is stopped for a predetermined time period, and waits until $Y \geqq X$ is satisfied. Subsequently, the suction pump 24 operates. To allow a user to recognize that the pump is stopped for the predetermined time period, the light emitting portion 26 of the ink tank 15 emits light. When an emitted state of the light emitting portion 26 is visually recognized by the user, the user is informed that the pump is stopped. In the same manner as described above, during this stop, a sufficient time elapses from the previous time when the waste ink is discharged into the ink tank 15 and absorbed by the waste ink absorption member 16. Therefore, the existence of the floating ink in the second storage section 12 of the ink tank 15 is eliminated. Therefore, even when the waste ink is newly discharged to the second storage section 12, the waste ink can satisfactorily be absorbed by the waste ink absorption member 16. The ink leakage due to overflow of the waste ink can be prevented. Finally, after the operation of the suction pump 24 ends, as shown in step 108, the total amount of the waste ink absorption and the collection time of the waste ink are recorded in the information recording medium 17 of the ink tank 15. In consequence, a series of operations of discharging the waste ink are completed.

According to the ink tank 15 of the present embodiment, since the ink tank includes the light emitting portion 26, the user can visually easily confirm that an ink sucking operation is stopped for the predetermined time period. It is to be noted that, in addition to the light emitting portion 26, the ink tank of the embodiment may include an alarming portion (not shown) which emits warning sound, if necessary, so that the user can confirm that the ink sucking operation is stopped fro the predetermined time period owing to the warning sound.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-244148, filed Sep. 8, 2006, which is hereby incorporated by reference herein in its entirety.

What is claimed is:

1. A recording device comprising:

a detachable liquid container that includes an absorption member to store a waste liquid collected from a recording head, and an information holding portion which retains information;

a pump which feeds the waste liquid collected from the recording head to the liquid container; and a control unit configured to control an operation of the pump based on the information retained by the information holding portion, the information including (i) information on a total amount of the waste liquid absorbed by the absorption member, (ii) information on a previous operation time of the pump, and (iii) information on a waiting time from an operation of the pump to a next operation of the pump, which corresponds to the total amount of the waste liquid absorbed by the absorption member, wherein the information on the waiting time is changed according to the total amount of the waste liquid absorbed by the absorption member, and when the total amount of the waste liquid absorbed increases, the waiting time increases, and wherein when the information retained by the information holding portion indicates that the waiting time has not elapsed since the previous operation time of the pump and operation of the pump is required, the control unit operates the pump after the waiting time elapses.

2. The recording device according to claim 1, wherein the waiting time is a time required until an amount of the waste liquid which has been fed into the liquid container and has not been absorbed by the absorption member decreases to a predetermined amount or less.

3. The recording device according to claim 1, wherein the information on the previous operation time of the pump is information on a time when the pump is stopped.

4. The recording device according to claim 1, wherein the information on the waiting time corresponds to a table of a plurality of stages of waiting time corresponding to a plurality of stages of the total amount of the waste liquid absorbed by the absorption member.

5. The recording device according to claim 1, wherein when the pump feeds the waste liquid to the liquid container, the control unit rewrites the information on the total amount of the waste liquid absorbed by the absorption member, retained in the information holding portion, based on an amount of the waste liquid fed to the liquid container.

6. The recording device according to claim 5, wherein the control unit uses information on an amount of waste ink generated by at least one mode of restorative suction and at least one mode of preliminary discharge to calculate the amount of the waste liquid fed to the liquid container by the pump.

7. A waste liquid collection system comprising:

a detachable liquid container that includes an absorption member to store a waste liquid collected from a recording head, and an information holding portion which retains information; and a recording device having a pump which feeds the waste liquid collected from the recording head to the liquid container, and a control unit which controls the pump, wherein the control unit is configured to control an operation of the pump based on the information retained by the information holding portion, the information including (i) information on a total amount of the waste liquid absorbed by the absorption member, (ii) information on a waiting time from an operation of the pump to a next operation of the pump, which corresponds to the total amount of the waste liquid absorbed by the absorption member, and (iii) information on a previous operation time of the pump, wherein the information on the waiting time is changed according to the total amount of the waste liquid absorbed by the absorption member, and when the total amount of the waste liquid absorbed increases, the waiting time increases, and wherein when the information retained in the information holding portion indicates that the waiting time has not elapsed since the previous operation time of the pump and operation of the pump is required, the control unit operates the pump after the waiting time elapses.

8. The waste liquid collection system according to claim 7, wherein the waiting time is a time required until an amount of the waste liquid which has been fed into the liquid container and has not been absorbed by the absorption member decreases to a predetermined amount or less.

9. The waste liquid collection system according to claim 7, wherein the information on the previous operation time of the pump is information on a time when the pump is stopped.

10. The waste liquid collection system according to claim 7, wherein the information on the waiting time corresponds to a table of a plurality of stages of waiting time corresponding to a plurality of stages of the total amount of the waste liquid absorbed by the absorption member.

11. A liquid container detachably mountable on a recording device comprising:

a first storage section in which a liquid to be supplied to a recording head is stored;

a second storage section that includes an absorption member in which a waste liquid collected from the recording head is absorbed and stored; and an information holding portion which retains information, including (i) information on a total amount of the waste liquid absorbed by the absorption member, (ii) information on a waiting time, corresponding to the total amount of the waste liquid absorbed by the absorption member, from a time when the absorption member absorbs the waste liquid until a state suitable for a next absorption of the waste liquid is obtained, and (iii) information on a previous collection time of the waste liquid, wherein the information on the waiting time is changed according to the total amount of the waste liquid absorbed by the absorption member, and when the total amount of the waste liquid absorbed increases, the waiting time increases, and wherein when the information retained by the information holding portion indicates that the waiting time has not elapsed since the previous collection time of the waste liquid and an operation to collect the waste liquid is required, the operation is executed after the waiting time elapses.

12. A liquid container detachably mountable on a recording device having a pump to feed, to the liquid container, a liquid which has been collected from a recording head and which is not used in recording, and a control unit which controls the pump, the liquid container comprising:

a first storage section in which a liquid to be supplied to the recording head is stored;

a second storage section that includes an absorption member in which the liquid fed by the pump is absorbed and stored; and an information holding portion which retains information for use by the control unit in controlling the pump, the information including:

(i) information on a total amount of the liquid absorbed by the absorption member, (ii) information on a waiting time from an operation of the pump to a next operation of the pump, which corresponds to the total amount of the liquid absorbed by the absorption member, and (iii) information on a previous operation time of the pump, wherein the information on the waiting time is changed according to the total amount of the liquid absorbed by the absorption member, and when the total amount of the liquid absorbed increases, the waiting time increases, and wherein when the information retained in the information holding portion indicates that the waiting time has not elapsed since the previous operation time of the pump and operation of the pump is required, the control unit operates the pump after the waiting time elapses.

13. The liquid container according to claim 12, wherein the information on the total amount of the liquid absorbed by the absorption member is calculated by the control unit after the operation of the pump.

14. The liquid container according to claim 13, further comprising:

a light emitting portion which emits light, based on information sent from the control unit, from a time when the waiting time has not elapsed since the previous operation time of the pump and operation of the pump is required until the waiting time elapses.

15. The liquid container according to claim 14, wherein the information on the waiting time corresponds to a table of a plurality of stages of waiting time corresponding to a plurality of stages of the total amount of the waste liquid absorbed by the absorption member.

16. An ink jet recording method comprising:

discharging ink droplets to form an image on a recording material;

collecting waste ink which does not contribute to the forming of the image by an ink absorption member disposed in an ink tank;

reading information stored in an information holding portion, disposed in the ink tank, wherein the information includes:

(i) information on a total amount of waste ink absorbed by the absorption member, (ii) information on a waiting time from an operation of a pump to a next operation of the pump, which corresponds to the total amount of the waste ink absorbed by the absorption member, and (iii) information on a previous operation time of the pump;

operating the pump in accordance with the information read from the information holding portion, wherein when the waiting time has not elapsed since the previous operation time of the pump and operation of the pump is required, the pump is operated after the waiting time elapses;

increasing the waiting time in accordance with an increase in the total amount of absorbed waste ink; and storing the increased waiting time in the information holding portion.

* * * * *